US007118454B2

(12) United States Patent
Bagdasarian

(10) Patent No.: US 7,118,454 B2
(45) **Date of Patent: *Oct. 10, 2006**

(54) MACHINE AND METHOD FOR FINISHING AUTOMOTIVE WHEELS

(76) Inventor: Ken L. Bagdasarian, 13170 Spring St., Baldwin Park, CA (US) 91706

( * ) Notice: Subject to any disclaimer, the term of this patent is extended or adjusted under 35 U.S.C. 154(b) by 0 days.

This patent is subject to a terminal disclaimer.

(21) Appl. No.: 11/208,846

(22) Filed: Aug. 22, 2005

(65) Prior Publication Data

US 2005/0277366 A1 Dec. 15, 2005

Related U.S. Application Data

(63) Continuation of application No. 10/770,080, filed on Feb. 2, 2004, now Pat. No. 6,945,852, which is a continuation of application No. 09/996,196, filed on Nov. 28, 2001, now Pat. No. 6,688,952, which is a continuation-in-part of application No. 09/541,424, filed on Apr. 3, 2000, now Pat. No. 6,364,754.

(51) Int. Cl.
*B24B 1/00* (2006.01)

(52) U.S. Cl. ..... 451/32; 451/326

(58) Field of Classification Search ..... 451/326–330, 451/32–36

See application file for complete search history.

(56) References Cited

U.S. PATENT DOCUMENTS

| | | | | |
|---|---|---|---|---|
| 1,491,602 | A * | 4/1924 | Fuller | 451/32 |
| 5,454,749 | A * | 10/1995 | Ohno | 451/329 |
| 5,531,637 | A * | 7/1996 | Kimura | 451/329 |
| 6,688,952 | B1 * | 2/2004 | Bagdasarian | 451/326 |
| 6,945,852 | B1 * | 9/2005 | Bagdasarian | 451/32 |

* cited by examiner

*Primary Examiner*—Dung Van Nguyen

(57) ABSTRACT

A machine for finishing automotive wheels having a rotatable turret, a plurality of containers or barrel cages journaled on the turret capable of selective rotation independent of the turret, with cartridges loaded into said containers or cages from the end through openings in the turret and fixtures in the containers that stably hold automotive wheels in said containers for selective reception of said media. The wheels are held in stable position by a fixture that comprises two part cushioned supports for permitting selective reception of media about the surface of the wheel that requires finishing. The cartridges may be loaded in and out of the barrel cages by means of a conveyor system.

18 Claims, 13 Drawing Sheets

MACHINE AND METHOD FOR FINISHING AUTOMOTIVE WHEELS

CROSS REFERENCE TO RELATED APPLICATIONS

This application is a continuation of Ser. No. 10/770,080 filed Feb. 2, 2004 now U.S. Pat. No. 6,945,852 which is a continuation of application Ser. No. 09/996,196 filed Nov. 28, 2001 now U.S. Pat. No. 6,688,952 B2 which is a continuation-in-part of application Ser. No. 09/541,424 filed Apr. 3, 2000 now U.S. Pat. No. 6,364,754.

STATEMENT REGARDING FEDERALLY SPONSORED RESEARCH OR DEVELOPMENT

Not Applicable

BACKGROUND OF THE INVENTION

This invention relates generally to the field of automotive wheel finishing, and more particularly to a machine, and fixture for surfacing, deburring, radiusing, descaling, polishing, abrading, or otherwise preparing automotive wheels for the application of many types of coating, plating, painting, and also to create a variety of final polishes or "finishes" for automotive wheels.

Machines for finishing small work pieces in a rotational barrel configuration are well known; however, a machine with the necessary fixturing and process for finishing automotive wheels through accelerated positive gravity induced burnishing is completely unknown in the automotive wheel manufacturing and finishing industries. In fact, manufacturers of automotive wheels currently use no type of a rotational barrel configuration technology to achieve the necessary pre-finishing preparation or to apply a variety of final "finishes" to automotive wheels. Finishing of large work pieces such as wheels requires a machine and fixturing system for holding the wheels to permit the wheels to receive high energy impacts from slurry mixtures without damaging the surface of the wheel in undesirable ways. Further, there does not exist a means for reducing the heat and pressure buildup in high energy machines running at high rotational speeds and generating large G forces.

Finishing small work pieces in a rotational barrel configuration is accomplished by use of slurry mixtures to create forces against the work pierces to grind down imperfections by utilizing gravitational forces to impart the force to the work piece in a desired fashion. Typically, the work pieces are placed loosely in a barrel and allowed to impact each other as well as the slurry mixture. Prior machines and methods for finishing small work pieces used hexagonal barrels mounted within a turret. The barrels typically moved in a counterclockwise fashion from the turret in such a way as to maintain a fixed position of the barrel with respect the horizon. This approach permitted the maximum impacting of the slurry mixture on the work pieces by agitating the system as the barrels rotated.

The deficiency of the prior technology is that there has existed no means or method for securing large work pieces such as automotive wheels in the proper position in a rotational barrel configuration machine to achieve an effective result. Further, no large barrels existed to hold automotive wheels and perform at high rotational speeds to achieve the desired results. Consequently, no machines utilizing a rotational barrel configuration have ever been developed with barrels of sufficient size to contain automotive wheels due, in part, to the lack of mechanisms for fixturing the wheels properly. Another problem solved by the instant invention when utilizing the large barrel sizes required to hold automotive wheels is a means for reducing the extreme heat and consequent pressure build-up inside the barrel which would result in unavoidable leakage detrimental to the process. Such means are integrated into the barrels and permit the entry of coolants to the system during rotation.

A further advantage of the presently disclosed system is the quick and simple loading and unloading of cartridges that may be inserted into barrel containers from the end of the rotating turrets. By end loading the cartridges through openings in the turret, insertion of wheels for finishing and removable of wheels is facilitated.

BRIEF SUMMARY OF THE INVENTION

The primary object of the invention is to provide a viable method for machine pre-finishing and final finishing of automotive wheels.

Another object of the invention is to provide an efficient system for loading and unloading cartridges into a rotating turret from the end.

Another object of the invention is to provide a method for high force pre-finishing and finishing of automotive wheels.

Another object of the invention is to allow automotive wheels going through the pre-finishing or final finishing process to become more controlled, thus making the automotive wheel more concentric.

Another object of the invention is to allow automotive wheels going through the pre-finishing or final finishing process to be prepared or finished throughout. The front, the back, the top, the bottom, the sides, inside crevasses, inside holes are radiused and polished creating a pre-finish or finish and otherwise eliminating sharp edges everywhere.

Another object of the invention is to provide a method for reduced time in pre-finishing or finishing automotive wheels.

Another object of the invention is to provide fixturing methods for automotive wheels which make utilization of the invention and related technology possible.

Another object of the invention is to provide a system to introduce a circulating coolant into the barrel while in motion to alleviate the extreme heat and consequent pressure build-up inside the barrel which would necessarily result from the G forces and friction generated to pre-finish or finish an object the size of an automotive wheel.

Another object of the invention is to provide a system for loading and unloading cartridges into a rotatable turret through openings in the turret to facilitate rapid re-loading of automotive wheels for finishing.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a machine for finishing automotive wheels having a rotatable turret, a plurality of containers that are journaled on the turret and capable of selective rotation independent of the turret; a plurality of removable cartridges insertable from the end into each of the containers for holding automotive wheels in the cartridges for selective reception of the media about the wheels.

In accordance with another preferred embodiment of the invention, there is disclosed a machine for finishing automotive wheels having a rotatable turret, a plurality of barrel cages that are journaled on the turret and capable of selective rotation independent of the turret; a plurality of cartridges capable of receiving media and of being stably held inside barrel cages; and a fixture in the cartridges that holds automotive wheels in the cartridges for reception of the media.

The drawings constitute a part of this specification and include exemplary embodiments to the invention, which may be embodied in various forms. It is to be understood that in some instances various aspects of the invention may be shown exaggerated or enlarged to facilitate an understanding of the invention.

Other objects and advantages will become apparent from the following descriptions, taken in connection with the accompanying drawings, wherein, by way of illustration and example, an embodiment of the present invention is disclosed.

BRIEF DESCRIPTION OF THE SEVERAL DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiments are provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
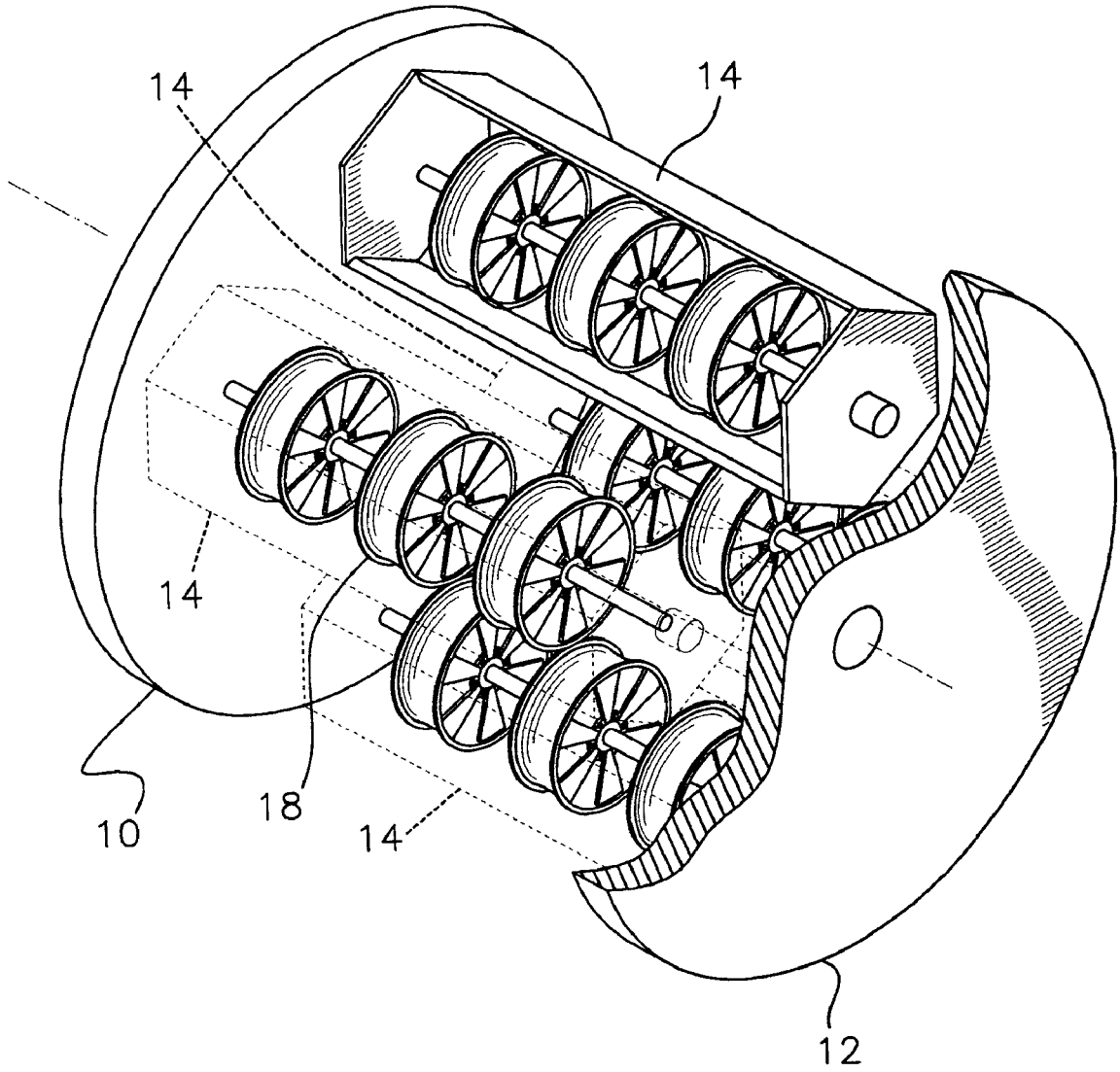
FIG. 1 is a perspective view of the invention showing a plurality of generally cylindrical container mounted on a turret.

Turning first to FIG. 1, there is shown a perspective view of a preferred embodiment of the invention. Turrets 10 and 12 are mounted on shafts and driven by motors, not shown, that turn the turrets at high rates of rotational speed. Journaled and mounted on the turrets are a plurality of generally cylindrical barrels 14 which rotate at high speeds and may be operable by additional motors independently of the rotation of the turrets. The barrels may have a variety of internal configurations including hexagonal, octagonal and other shapes to create sufficient agitation of material within during rotation. Mounted within each barrel are workpieces, shown here as relatively large automotive wheels 18. Wheels 18 are mounted generally perpendicularly to the barrels and are held in place through fixture means further described herein. The wheels may be mounted at an angle relative to the longitudinal axis of the barrel to facilitate the movement of media about the wheels. The barrels may also be lined in rubber or urethane and may be of any other generally cylindrical shape.

Upon activation by a motor to the turret, the barrels rotate to create high gravitational forces from rotational speeds of approximately 25–500 revolutions per minute. Barrels 14 are mounted by shaft and pulleys, not shown, to turrets 10 and 12 and may be rotated in a fixed position to counter rotation of the turrets or be separately powered by additional motors not shown.

Figure 2:
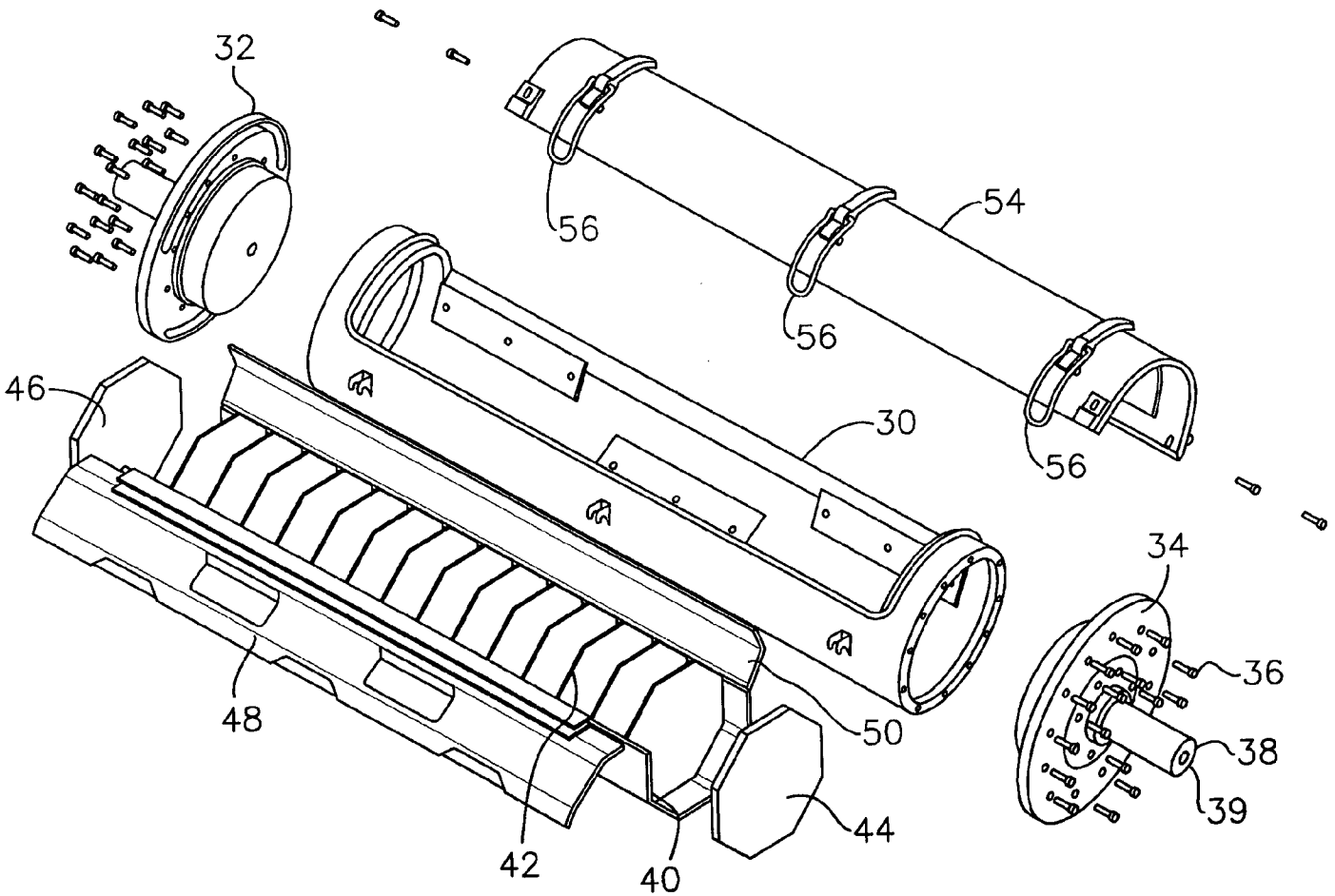
FIG. 2 is a perspective exploded view of the cartridge and barrel for loading automotive wheels in the barrel.

The process for finishing the wheels is generally described below. Wheels 18 are fixtured inside barrels 14 in an appropriate orientation to the longitudinal axis of the barrels. Once the wheels are fixed in the barrel, abrasive media, water, or other materials are added to the barrels. The barrels are sealed to prevent any leakage. As more fully shown in FIG. 2, the barrels are composed of a cylindrical tube 30 having two ends with sealed caps 32 and 34 affixed to the ends of the tube. Caps 32 and 34 are affixed to the tube 30 by a plurality of fasteners 36 to completely seal and close the end of the tube. Caps 32 and 34 have shafts 38 protruding outward along the longitudinal axis to permit mounting of the barrel on the turrets. The tube 30 has displaced within it a cartridge 40 that is affixed with a plurality of separator panels 42. The workpieces may be placed between the separator panels 42 to mount the workpieces and prevent lateral movement of the workpieces during rotation. Alternatively, the work pieces such as wheels may be mounted on a shaft going through the wheels or fixed in place through support cushions more fully shown in FIGS. 4, 5, 6 and 7. Cartridge 40 has end caps 44 and 46 that are affixed to the cartridge. Cartridge 40 has additional panels 48 and 50 that close the support structure before placement within the barrel. After cartridge 40 is closed with panels 48 and 50 are placed in the tube 30, door 54 may be latched with latches 56 to close and seal the tube. Once sealed, the tube is ready for high speed rotation and the finishing steps of the inventive method.

Due to the high pressure that may result form rotational speeds used in this process input means to the barrel are provided to introduce cooling fluids to the barrel to reduce temperature. The rotating shaft 38 is provided with a central boring hole 39 that runs the longitudinal length of the shaft to permit communication between the inside of the barrel and means for introduction of liquids to the barrel. The shaft 38 may be fitted with hardware, not shown, to allow a tube to run from the shaft to a pump or reservoir for the introduction of liquid into the barrel. Other approaches to entry in the container may be achieved via ports on end caps 32 and/or 34 so long as liquid is introduced in to the container and out of the container. Other input/output mechanisms may be designed so long as the amount of total media may be maintained at desirable levels throughout the rotation process. As heat or pressure build up, sensors may detect when liquids should be introduced and the means for introducing those liquids is activated and liquid is pumped through the hole 39 into the barrel. Alternatively, the means for introducing liquid may be set to continuously introduce or intermittently introduce liquid over a time period that maintains the temperature or pressure at desired levels. The means for pumping liquids may be any conventional mechanism and are well known in the art. By permitting introduction of liquid during the rotational phase, the high pressure associated with this system may be alleviated. Alternatively, an external water spray or other liquid may be applied to the outside of the system to reduce heating on the barrels, or the cartridges and cages depicted in FIGS. 11, 12 and 13.

Figure 3:
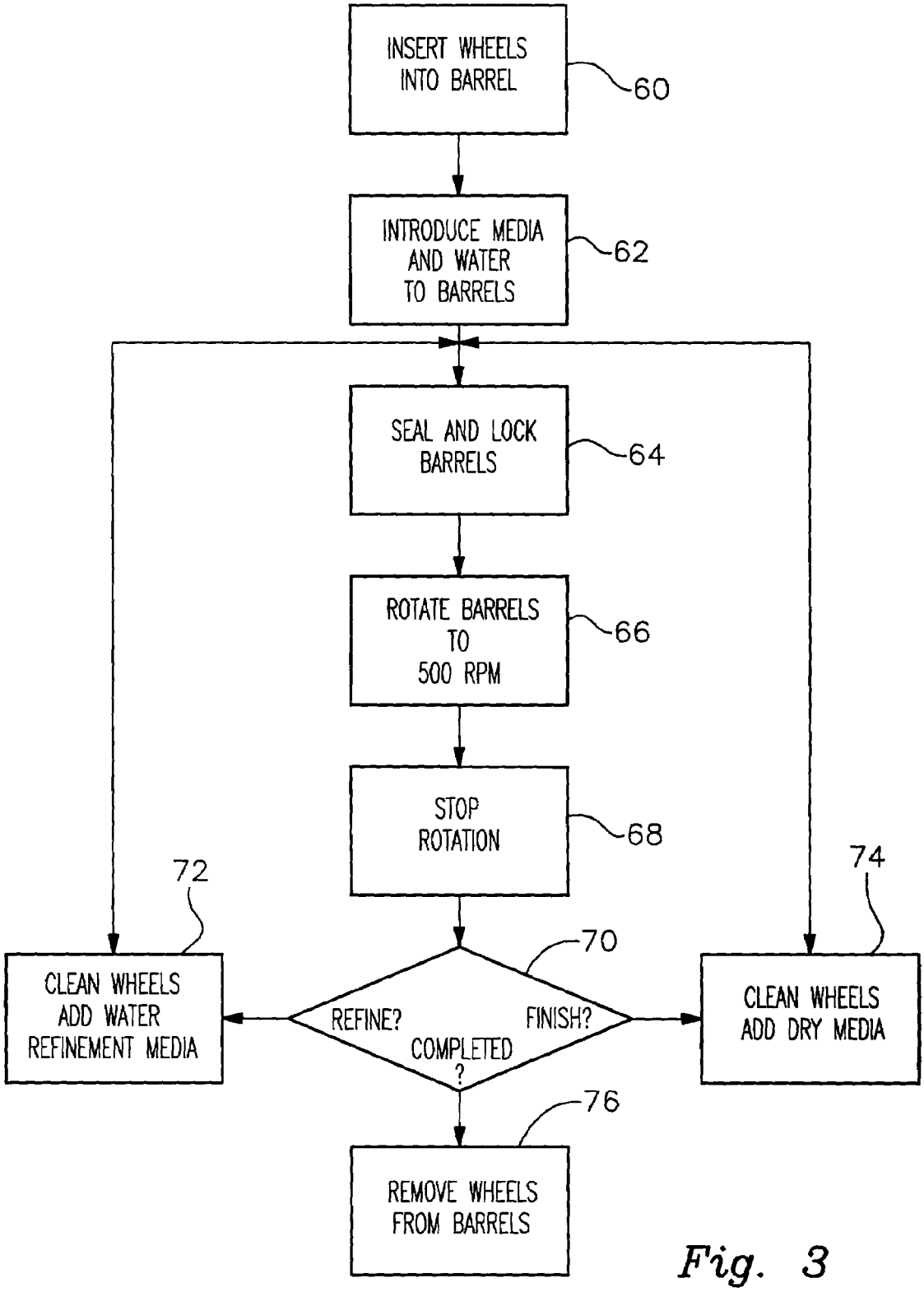
FIG. 3 is a block flow chart of the operations that comprise the method for finishing automotive wheels.

Turning now to FIG. 3, there is shown the overall process for finishing automotive wheels. The first step in the process is a cutting process. FIG. 3 shows, among other things, the steps involved in the cutting process. Wheels are mounted in the barrel at step 60. Media and water is introduced at step 62 to the barrel. Any desired media or liquid may be introduced into the barrel depending on the desired finishing outcome. The barrel is locked and sealed at step 64 and prepared for high rotational speeds. The turrets are activated by motors that turn the barrels up to speeds of approximately 75 to 500 rotations per minute at step 66. Step 66 shows a rotational speed of 500 rpm's, but any suitable speed that creates the high energy forces to abrade the wheels may be used. Preferably these speeds range from approximately 75 to 500 rpm's. Once the proper cycle time is achieved, the rotation is terminated and the cutting process is completed at step 68. Generally, as the speed of rotation is increased, the cycle time of the finishing process is generally reduced. As the speed of rotation is increased, the G forces on the wheels increase resulting in high pressure being applied to the wheels by the media and water. As the abrasives in the media impact the wheels, surface imperfections are abraded and the wheel obtains a shiny appearance.

The key factors affecting the degree of finishing are the amount and type of media and compound used, the speed of the turret, and the cycle time of the overall process. Different media used in the art are capable of achieving different finishes and cycle times depending on the desired results. The key to the inventive process is to stably mount the wheels in large cylinders and achieve high rotational speeds to create the force to drive the media against the wheels to abrade the surface in the desired amount. The media may be removed from the barrels and recycled for another process.

After the wheels are processed in the cutting process, they are prepared for the refinement process, if necessary, the finishing process or completion as shown in step 70. If the refinement process is desired, the wheels are removed, cleaned and reinserted into the barrels and new media is introduced to the barrel at step 72. Once the new media is introduced, the barrels are locked and sealed and the process proceeds as before at step 64. During the refinement process step, the wheels are exposed to a milder abrasive media. After the refinement process is finished, the wheels may be removed and plated by conventional means if that look is desired. If plating is not desired, a final finishing or polishing step can be achieved with the inventive process and apparatus.

If the refinement process step was not desired at step 70, the process proceeds to the polishing step at 74. The polishing steps begin with preparation of the wheels by removing and cleaning them at step 74 and introducing dry media. The finishing or polishing step requires that the wheels be placed in the barrels as before but with a dry media such as crushed walnut shells, corncob, or wood shavings possibly with other additives to give the wheels a polished luster. Once the media is properly introduced and the wheels are in place, the process proceeds as before through steps 64 through 68. In this process step, the rotating and loading is the same, but no water is used. High rotational speeds are used generating energy that heats the wheels to upwards to approximately 225 degrees F. Upon completion of these steps, the wheels are removed at step 76.

Figure 4:
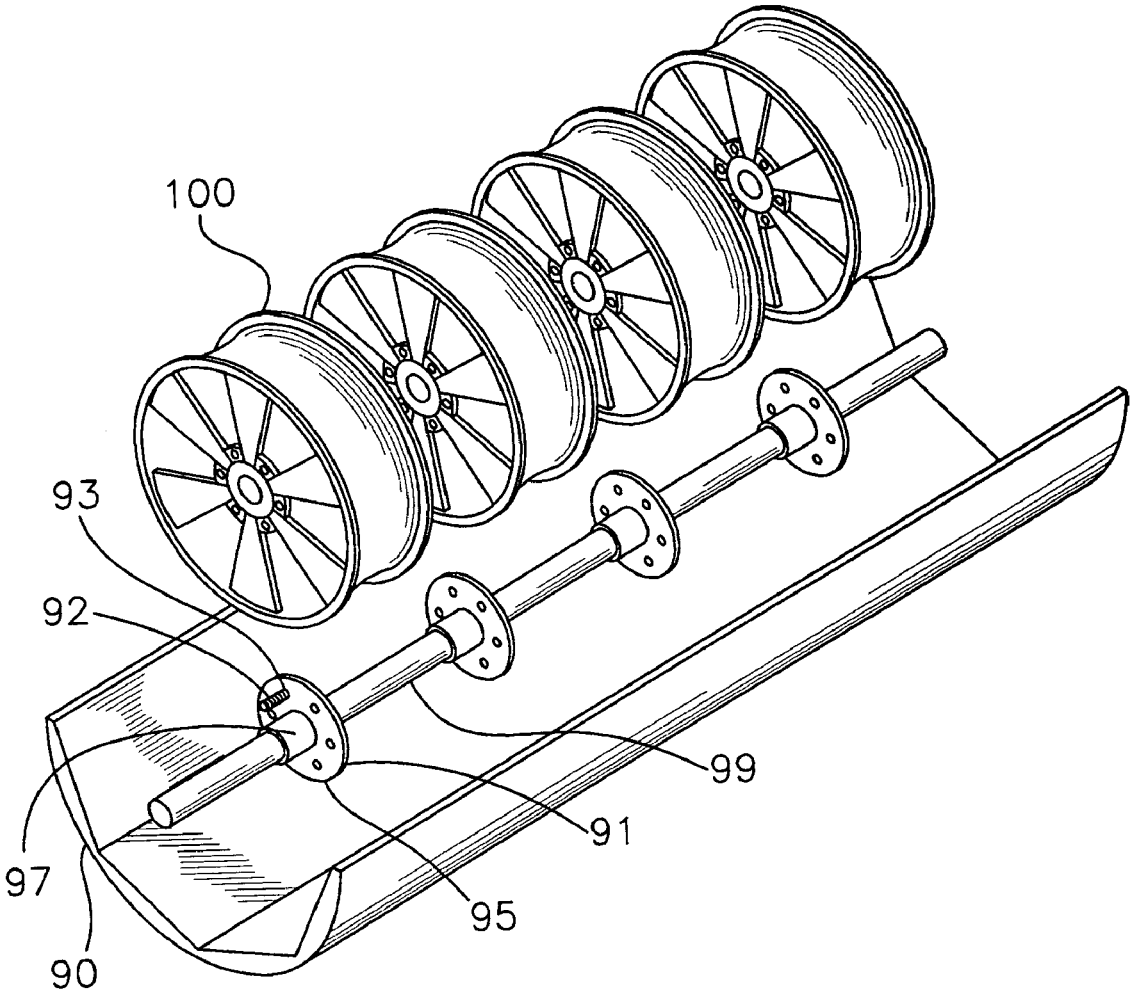
FIG. 4 is a perspective view of the lower portion of a cartridge with mounting plates for the wheels.

FIG. 4 shows a fixturing for stably holding the wheels in the cartridge during the rotational process. Alternatively, the fixturing may be placed directly into the container and no cartridge used. So long as the container can be sealed and media introduced, the wheels may be placed directly into the container and stably fixed therein. Bottom half 90 of the cartridge is shown having an interior surface that is generally cylindrical with a plurality of flat faces making up a portion of the octagonal cartridge shape. A mounting shaft 99 runs the longitudinal length of the cartridge and is mounted on the inside end plates of the cartridge not shown. Shaft 99 is capable of receiving wheel mounting plates 91 via mounting tube 97 which is flanged onto plate 91. The mounting tube 97 may be situated at a 90 degree angle to the plate 91, but preferably is mounted at an angle of approximately 45 to 75 degrees relative to the plate. By angling the mounting plate to the shaft, the wheels 100 that are mounted to the plate receive added abrading action during the rotational process. The wheels 100 are mounted onto the plate 95 by conventional means such as a bolt 92 which is screwed into mounting holes 93 through holes that are standard on automotive wheels. The plates 91 may be configured to receive certain configurations of wheels or be universal by having several mounting holes 93 positioned to mate with the variety of mounting holes present in automotive wheels. The plate 91 may be secured to the shaft 99 by a set screw, not shown, or any other conventional means for inhibiting rotational movement of the plate relative to the shaft during the process. Other mechanisms for securing the plate may include a mating wing in the tube 97 that fits into a slot running down the longitudinal length of shaft 99. Other securing means are well known in the art and need not be set forth here. The fixturing mechanism shown is designed to hold the wheels in a fixed position relative to the rotational movement of the barrels. The wheels are preferably mounted to the plate on their inside surface much the same way that an automotive wheels is mounted with one side affixed to the axle of the car. In this way, the surfaces that are most desirable for finishing are fully exposed to the media and will receive the maximum finishing from the process.

Figure 5:
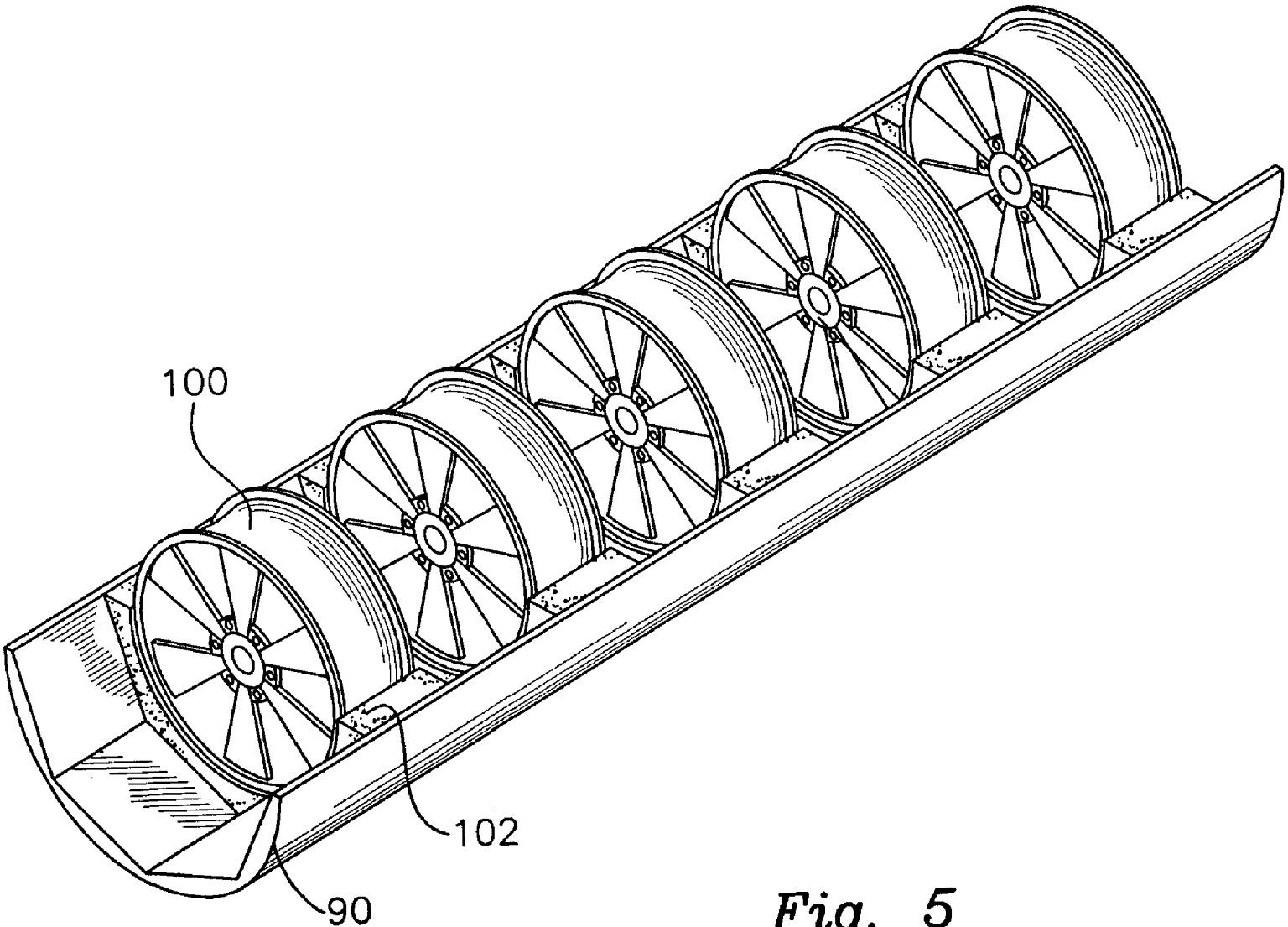
FIG. 5 is a perspective view of the cartridge with soft cushioning supports on the lower portion of the wheels.

FIG. 5 shows an alternative mounting means that may be used in the invention. Bottom half 90 of cartridge is shown with a plurality of soft cushioning supports 102 displaced below each wheel which are part of a two part fixture. The supports 102 may be made of any suitable material that provides a stable support for the wheel and does not impart any excessive abrading to the wheel during the process. Molded urethane, rubber, plastic, and other synthetic materials may be used so long as the wheels are set into the cushion. Cushions 102 have mating upper cushions that are configured in such a way as to cover the top portion of the wheel when the cartridge is closed. The cushions 102 may be shaped on one side to match the outline of the inner surface of the cartridge, in this case, octagonally. The other surface of the cushion is shaped to fits the general contour of the wheel 100. When both the top and bottom halves of the cushions are in place, the cartridge is closed and the wheels are properly positioned and held in place by friction. The cushions are designed so that upon closing the cartridge the wheels cannot substantially move long the longitudinal axis and are fixed in the rotational axis to prohibit movement of the wheels during the process. The wheels should preferably be spaced approximately 4 inches apart to permit maximum and optimal contact with the media. Although the cushions are shown covering substantially all of the surface of the portion of the wheel that mates with a tire, the cushions need only be large enough to hold the wheels in place. Thus, the cushions could be designed to cover less than the full circumference of the wheel and still hold the wheels in place sufficient for this process. Disadvantages of such an approach would be that certain portions on the wheels would be acted on by the media while other portions would not. However, there may be some applications where this is not a problem and thus a suitable fixturing means.

Figure 6:
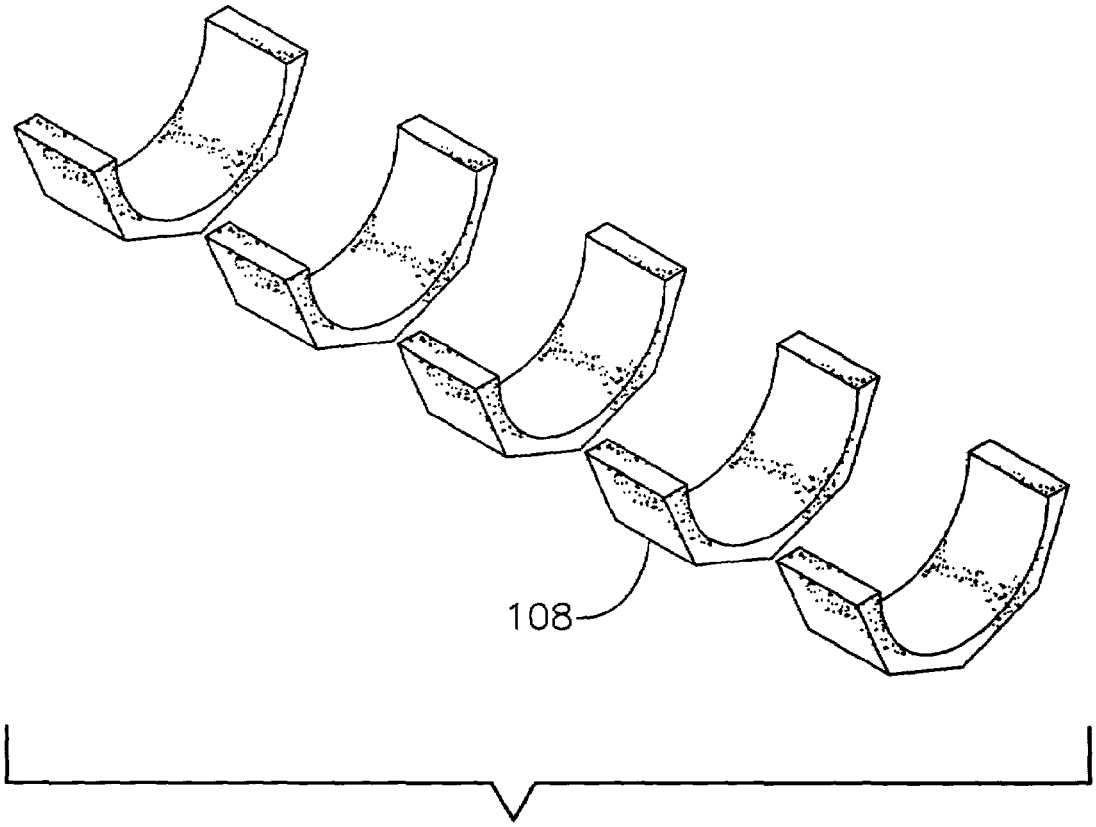
FIG. 6 is a perspective view of the mating upper cushioning supports for use in a cartridge.

FIG. 6 shows the mating upper cushions that are placed on the upper side of the wheels after insertion into the cartridge. The upper cushions 108 are generally mirror images of the lower cushions having the same outer contour to fit the cartridge and the rounded inner surface to fit the wheels.

Figure 7A:
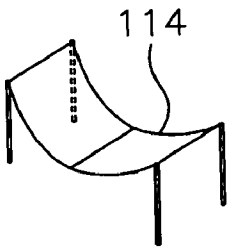
FIG. 7 is a perspective view of the bottom half of the cartridge with wheels mounted on cushioning supports and fixed in place by tie straps over the top of the wheels. Also shown in FIG. 7A is a alternative support that may be placed under or over the wheels for stable engagement in the container.
Figure 7:
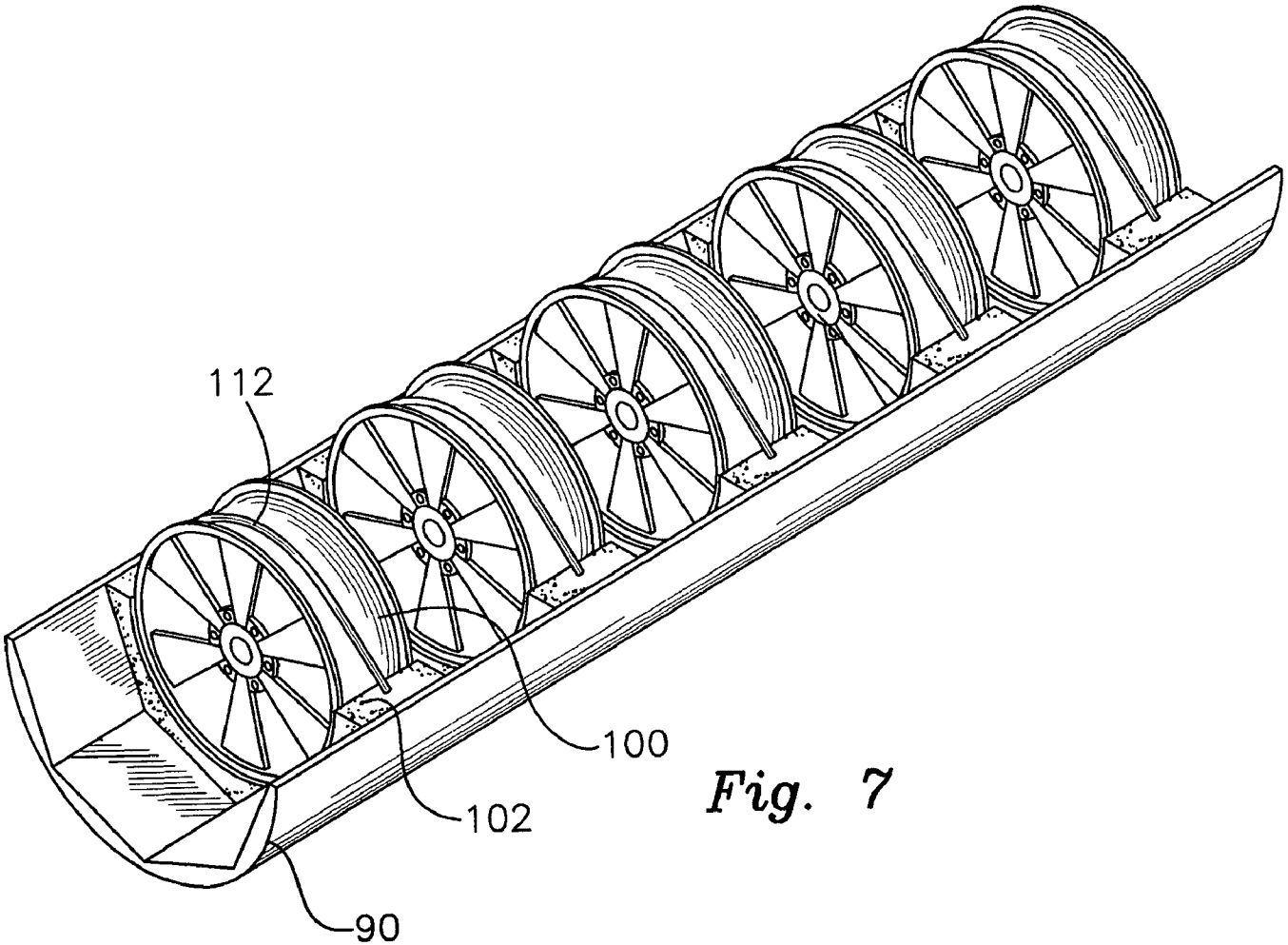

FIG. 7 shows another fixturing means for holding the wheels in place during the process. The lower half of the wheels is cushioned with a molded cushion support 102 as shown in FIG. 5. However, rather than use a mating upper cushion, the upper portion of the wheel is held into place by a tie strap 112 that is affixed to the cushioning support or to the side of the cartridge. Tie strap 112 may be of any suitable material such as plastic, metal, or other cord so long as it holds the wheels in place during the process and does not permit excessive movement of the wheel. Such a strap would permit the media to act on a portion of the wheel, but as previously noted this may be acceptable in certain circumstances.

Other fixturing means may be accomplished by predetermined mounting hardware on the inside of the cartridge pieces or the container or mounting pieces that are placed into the cartridge or the container as the wheels are loaded. Such a mechanism could be configured of support structures having several legs for supporting the wheel in a position away from the outer edges of the cartridge but doing so in a stable manner that permits the media to reach most portions of the wheel that require finishing. A suitable mounting support 114 is shown in FIG. 7A. Such a support could be placed into the cartridge upon which the wheel is placed or be fixed to the inside wall of the cartridge. Then a mating support of similar design could be placed on the top of the wheel or fixed to the top inside of the cartridge before closing the cartridge. Depending on the size of the wheel and the cartridge, the support pair may be configured to provide a tight fit within the container to prevent lateral and rotational movement of the wheel during the rotational process. This would provide stable support to the wheel during rotation and permit the media to reach the desired portions of the wheel.

Figure 8A:
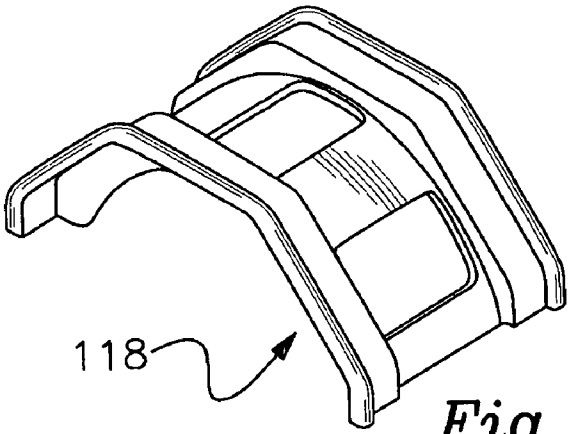
FIG. 8 is a perspective view of the wheel saddle assembly for stable engagement of the assembly in the cartridge. Also shown in FIGS. 8A and 8B are perspective views of the upper and lower portions of the wheel saddle assembly.
Figure 8B:
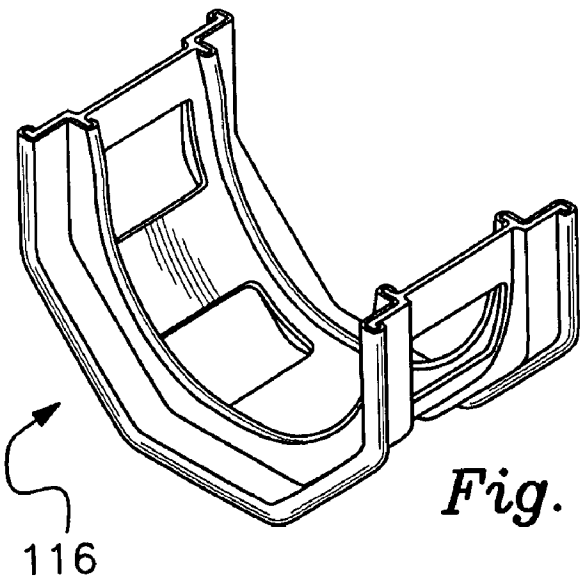
Figure 8:
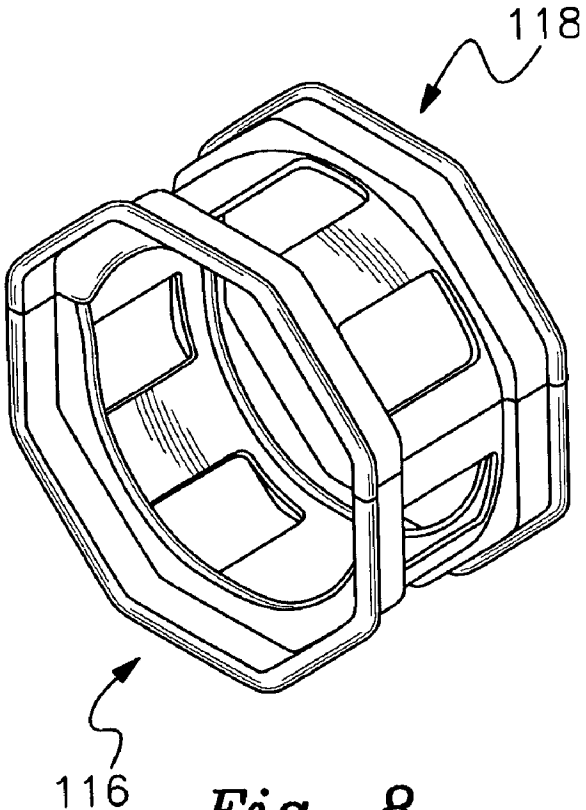

FIGS. 8, 8A and 8B show yet another approach to fixing wheels inside the cartridge. The wheel saddle assembly consists of a lower mating cradle 116 and upper mating cradle 118 which firmly holds a wheel securely in the container (or "barrel"). The wheel saddle assembly (comprising the lower 116 and upper 118 mating cradle) may be made of any suitable material that provides a stable support for the wheel and does not impart any excessive abrading to the wheel during the process. In a preferred embodiment wheel saddle assembly is composed of casted aluminum. The saddle assembly has two raised ridges that, when encased in molded urethane, rubber, plastic, and other synthetic materials, will grip the wheel during the finishing process. Additionally, there are "pass-through" windows that will allow water to flow freely over the outside diameter of the wheel, through the fixture and up against the wall of the cartridge. This flow characteristic provides a path for heat exchange whereby the heat is extracted from the wheel, and carried away to the skin of the cartridge. The lower and upper mating cradles of the wheel saddle assembly may use molded urethane, rubber, plastic, and other synthetic materials for cushioning so long as the wheel is stably held by the wheel saddle assembly.

Figure 9:
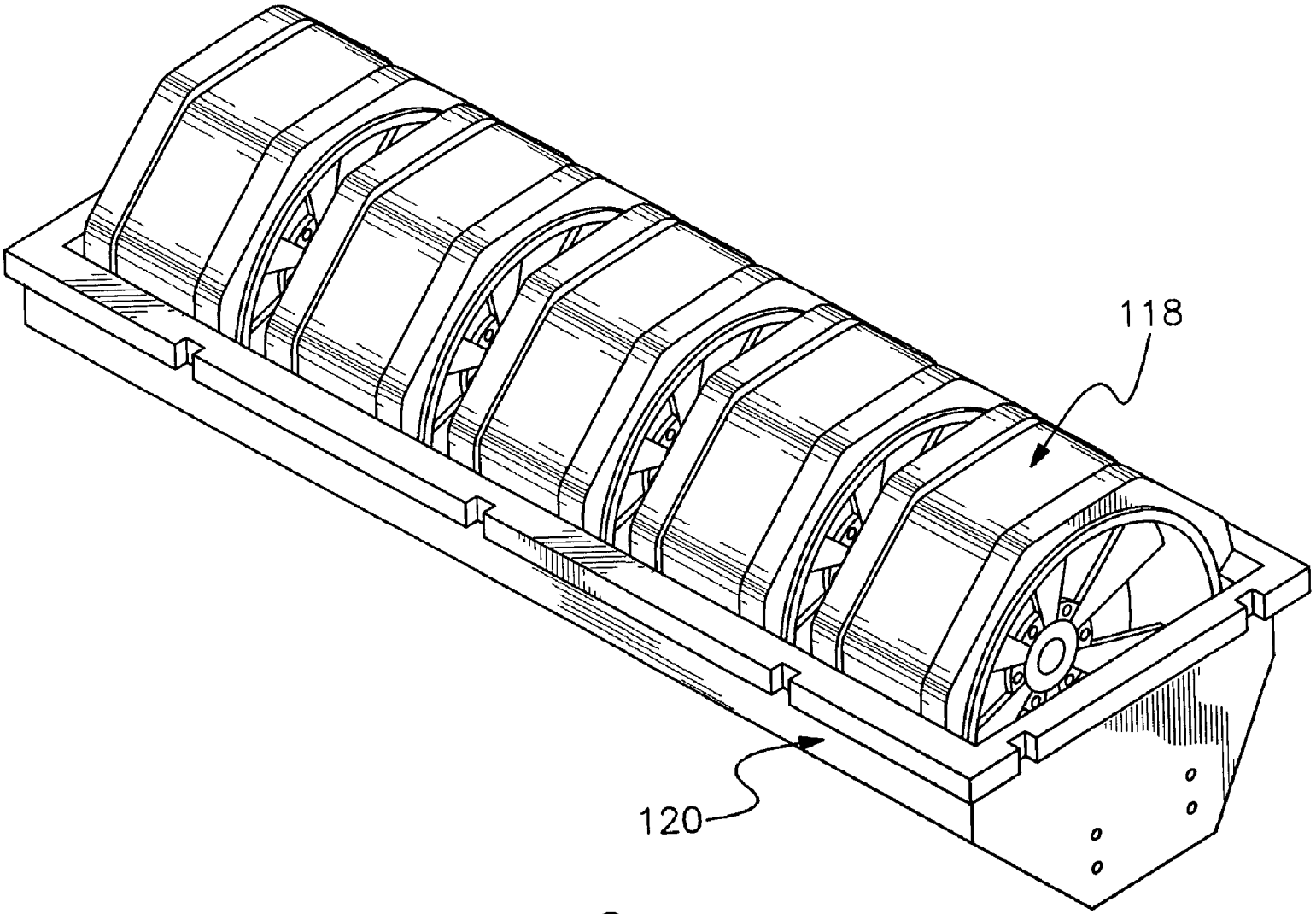
FIG. 9 is a perspective view of a cartridge loaded with wheels secured by the wheel saddle assemblies.

FIG. 9 shows the wheel saddle assemblies placed in a cartridge 120. The wheel saddle assemblies (comprising the lower mating cradle not shown, upper mating cradle 118 and the wheel to be finished) are placed in the cartridge 120. In a preferred embodiment the lower mating cradle portion of the wheel saddle assembly will be held in place by the adjacent lower mating cradle (one for each wheel, and wheel size specific) so as to enhance positioning and over-all stability. Each upper mating cradle 118 will be individually removable to ease in positioning each wheel optimally, and obtaining the proper clamping forces required when the cartridge lid is installed and clamped shut. Media for polishing and finishing is introduced into the cartridge prior to sealing the cartridge. The process as described in FIG. 3 is used with this embodiment, however media and/or water is introduced inside the cartridge prior to sealing the cartridges and loading the cartridges into the barrel cages.

Figure 10:
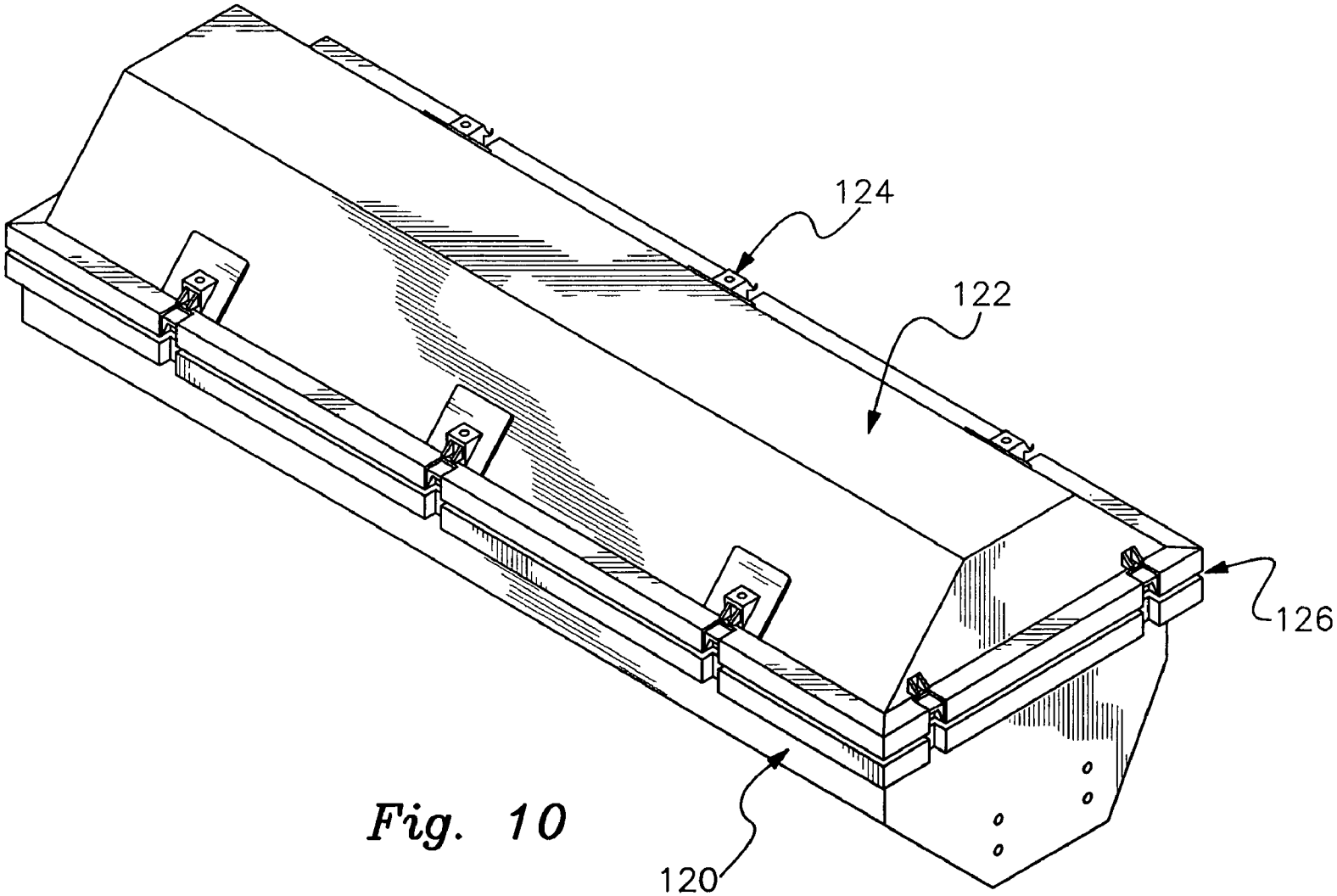
FIG. 10 is a perspective view of a cartridge with the top lid closed.

In FIG. 10 the cartridge 120 is sealed (after introduction of the media and/or water) using a top lid 122 and bottom half 126 and secured using bolts, screws or other fasteners at fixed points 124 on the cartridge 120 and top lid 122.

Figure 11:
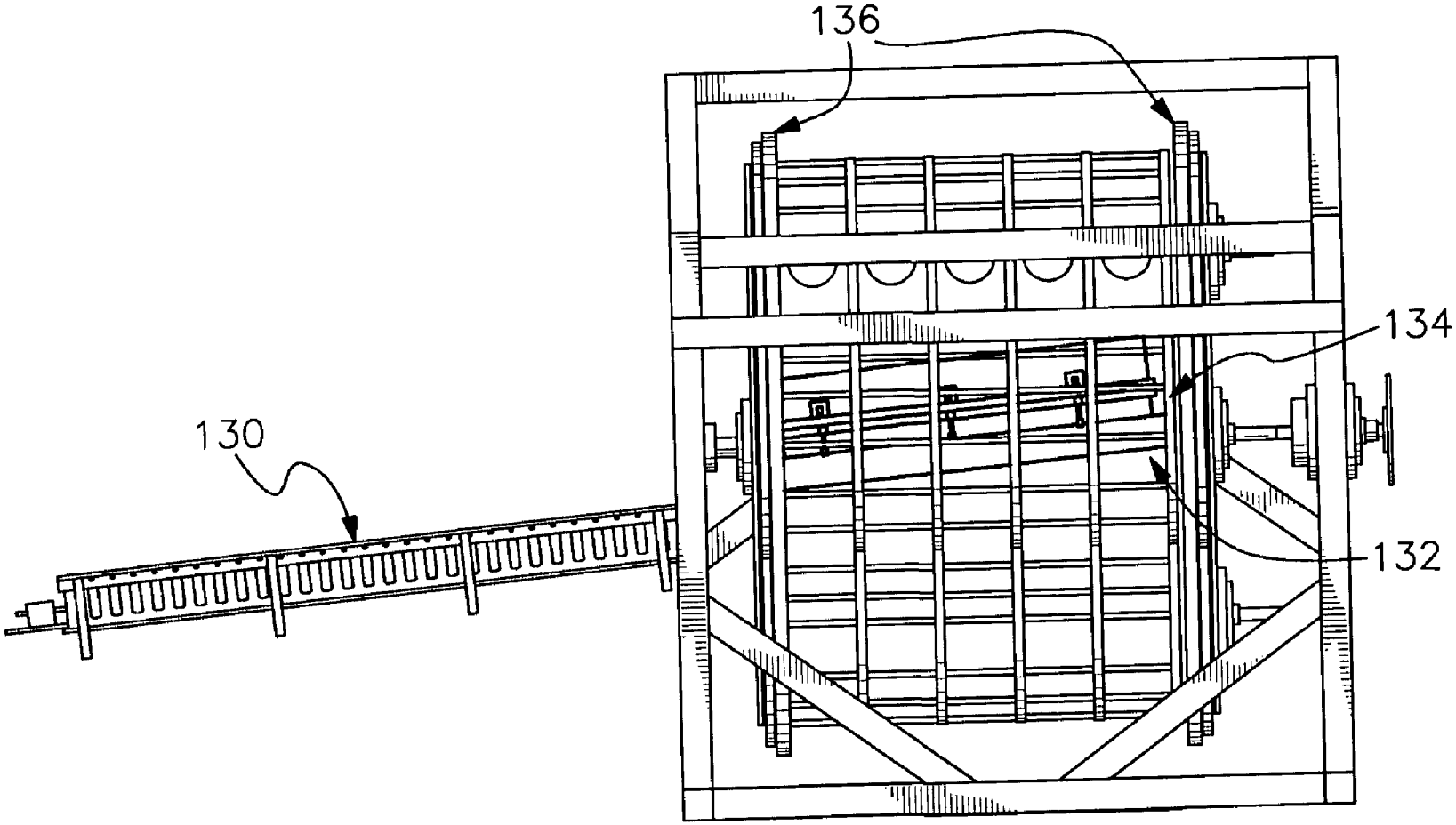
FIG. 11 is a side view of the invention showing a plurality of generally cylindrical barrels cages mounted on a turret and a conveyor system for loading and unloading previously described cartridges into said barrel cages.
Figure 12:
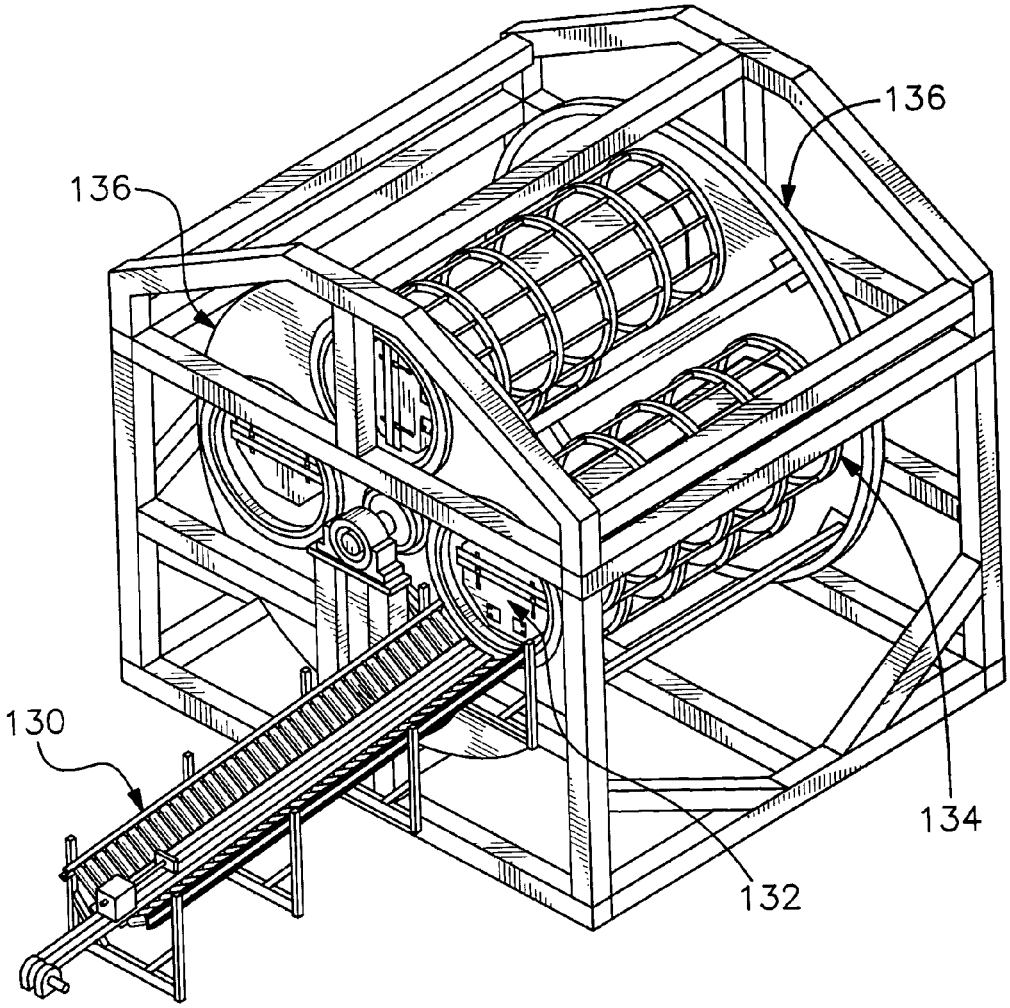
FIG. 12 is a perspective view of the invention showing a plurality of generally cylindrical barrel cages mounted on a turret and a conveyor system for loading and unloading previously described cartridges into said barrel cages.
Figure 13:
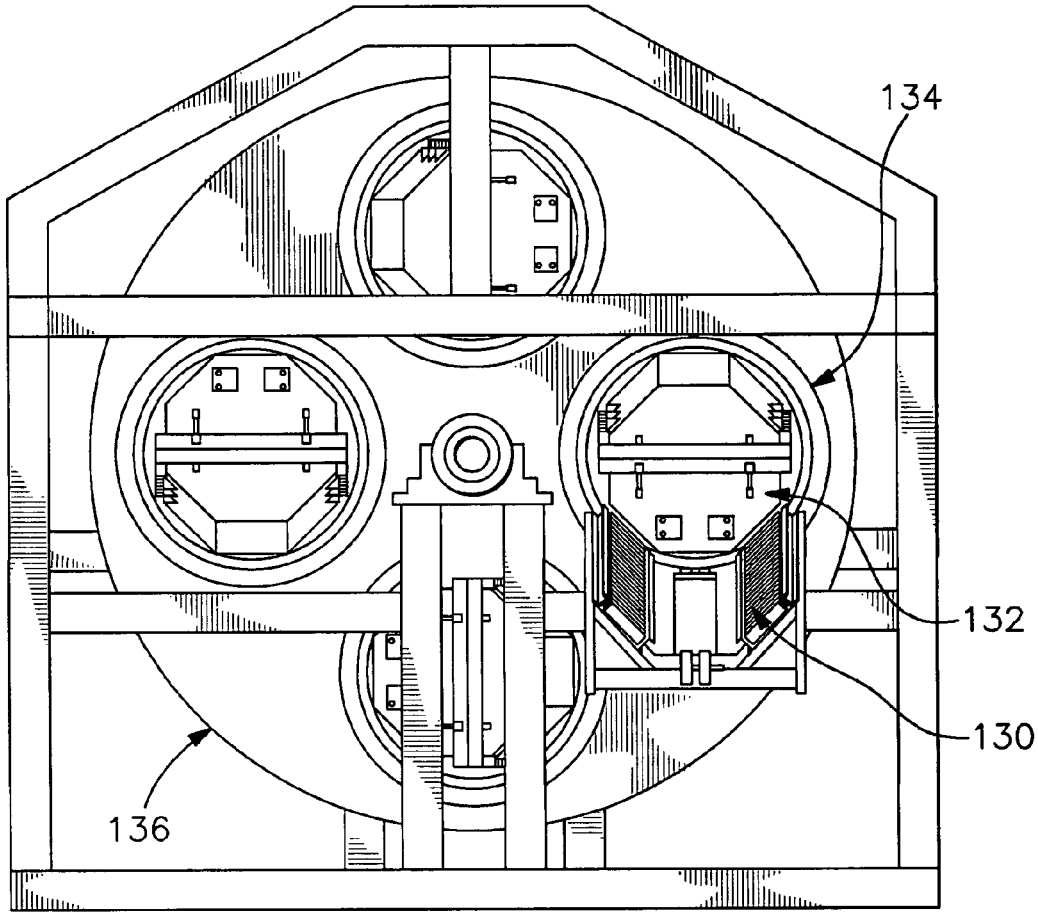
FIG. 13 is an end view of the invention showing a plurality of generally cylindrical barrel cages mounted on a turret and a cut away of the conveyor mechanism for loading and unloading previously described cartridges into said barrel cages.

FIGS. 11, 12 and 13 show side, perspective and end views of the invention as well as the use of a conveyor system 130 to easily load the sealed cartridges 132 described above into the barrel cages 134. The end loading of sealed cartridges 132 via a conveyor system 130 saves time and simplifies the design and operation of the barrel cages 134 and turret mechanisms as the introduction of the media and/or water is done during loading of the cartridges away from the barrel cages 134 and turret 136. This helps reduce down times in re-fitting cartridges with wheels.

Turrets 136 are mounted on shafts and driven by motors, not shown, that turn the turrets at high rates of rotational speed. Journaled and mounted on the turrets are a plurality of generally cylindrical barrels cages 134 which rotate at high speeds and may be operable by additional motors independently of the rotation of the turrets. FIG. 11 shows the barrel cages 134 displaced between the two turrets 136 where one end of each cage is mounted on a shaft that is independently moved by motors and pulleys and belts not shown and well known in the art and the other end is journaled in a hole in the turret shown in FIGS. 12 and 13. The cage is journaled, i.e. mounted on a bearing, through conventional means well known in the art. The barrel cages 134 are thus mounted at both ends on the two turrets and are able to rotate independently of the rotation of the turrets. The barrel cages 134 may have a variety of internal configurations including generally cylindrical and having a variety of cross sectional forms including circular, hexagonal, octagonal and other shapes and may be open or closed. The cartridges 132 are sealed with the workpieces (normally wheels), a means to hold the workpieces stably in place inside the cartridge and the media. The cartridges 132 are then placed on a conveyor mechanism 130 on a longitudinal axis and moved lengthwise through one of the plurality of openings in one of the turrets 136 into a barrel cage 134. The cartridges 132 may be secured in the barrel cages 134 through a variety of means including but not limited to: doors that close the loading end of the barrel cage after placement of the cartridge; fastening devices such as bolts screws or latches; or releasable interlocks which engage when the turret and barrel cage motors operate. The cartridges may be loaded and fixed in the cages at a small angle to enhance the action of the media on the finishing of the wheels. Preferably the angle should by 5 to 10 degrees.

Upon activation by a motor to the turret 136, the barrel cages 134 and cartridges 132 rotate rapidly to create high gravitational forces. Barrel cages 134 are mounted by shaft and pulleys, not shown, to turrets 136 and may be rotated in a fixed position to counter rotation of the turrets 136 or be separately powered by additional motors not shown.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A method for making an automotive wheel comprising the steps of:

placing a wheel into one of a plurality of removable cartridges having a separator in said cartridge to isolate said wheel from other wheels in said cartridge;

inserting media in said cartridge to enable the media to contact said wheel;

inserting said cartridge into a container journaled on a turret wherein said container is capable of selective rotation independent of said turret;

rotating said turret to apply said media to finish the wheel.

2. A method as claimed in claim 1 wherein said turret has openings for receiving said cartridges for insertion into said containers.

3. A method as claimed in claim 1 wherein said cartridge has a plurality separators for dividing said cartridge into separate regions for placement of one wheel to contain said automotive wheels in said cartridges for selective reception of said media about the surface that require finishing on the wheels.

4. A method as claimed in claim 3 wherein said separators are cushioned where contact with said wheel occurs.

5. A method as claimed in claim 1 wherein said cartridges are generally cylindrical having a hexagonal cross section.

6. A method as claimed in claim 5 wherein said containers are generally cylindrical.

7. A method as claimed in claim 1 wherein said containers are barrel cages.

8. An automotive wheel made from a method comprising the steps of:

placing a wheel into a separated portion of one of a plurality of removable cartridges;

inserting media in said cartridge to enable the media to contact said wheel;

inserting said cartridge in a container journaled on a turret wherein said container is capable of selective rotation independent of said turret; and rotating said turret to apply said media to finish the wheel.

9. The invention of claim 8 wherein said cartridges are generally cylindrical having a hexagonal cross section.

10. The invention of claim 8 wherein said separator is a vertical panel configured to prevent engagement of one wheel with another wheel in said cartridge.

11. The invention of claim 8 wherein said containers are barrel cages.

12. The invention of claim 8 wherein said cartridges are end loaded via a conveyor into said containers and stably held therein.

13. The invention of claim 8 wherein said turrets have openings for receiving said cartridge into said cages.

14. The invention of claim 8 further comprising a fixture for stably holding said wheel in said cartridge.

15. A machine for finishing automotive wheels comprising;

a rotatable turret;

a plurality of containers that are journaled on said turret and capable of selective rotation independent of said turret; and a separator in each of said containers for holding individual automotive wheels in said containers for selective reception of media about the wheels.

16. The invention of claim 15 wherein said containers have a hexagonal cross section.

17. The invention of claim 15 wherein said separator stably holds said wheel during rotation of said turret.

18. The invention of claim 15 further comprising a plurality of separators in said containers.

* * * * *